US008574001B2

(12) United States Patent
Lee

(10) Patent No.: US 8,574,001 B2
(45) Date of Patent: Nov. 5, 2013

(54) ELECTRONIC CONNECTOR AND ASSEMBLY COMPRISING THE SAME

(75) Inventor: DawWei Lee, Singapore (SG)

(73) Assignee: Molex Incorporated, Lisle, IL (US)

( * ) Notice: Subject to any disclaimer, the term of this patent is extended or adjusted under 35 U.S.C. 154(b) by 121 days.

(21) Appl. No.: 13/189,245

(22) Filed: Jul. 22, 2011

(65) Prior Publication Data

US 2012/0190228 A1 Jul. 26, 2012

(30) Foreign Application Priority Data

Jul. 22, 2010 (CN) ..... 2010 2 0268912

(51) Int. Cl.
*H01R 3/00* (2006.01)

(52) U.S. Cl.
USPC ..... 439/490; 439/271; 439/559; 200/313; 200/317

(58) Field of Classification Search
USPC ..... 439/490, 488, 271, 367, 559; 385/94, 385/13; 362/551, 555, 560, 562, 311, 632, 362/633, 634, 581, 267; 372/12; 349/58, 349/59, 60, 61, 62, 63, 64, 65; 200/317, 200/313, 314
See application file for complete search history.

(56) References Cited

U.S. PATENT DOCUMENTS

| | | | | |
|---|---|---|---|---|
| 7,094,099 | B2 * | 8/2006 | Daggett et al. | 439/567 |
| 7,367,851 | B2 * | 5/2008 | Machado et al. | 439/676 |
| 7,503,790 | B2 * | 3/2009 | Bodmann et al. | 439/271 |
| 7,581,980 | B2 * | 9/2009 | Chiu et al. | 439/466 |
| 2009/0080198 | A1 * | 3/2009 | Thornton | 362/297 |

FOREIGN PATENT DOCUMENTS

CN 101593900 A 12/2009

* cited by examiner

*Primary Examiner* — Renee S Luebke
*Assistant Examiner* — Harshad Patel
(74) *Attorney, Agent, or Firm* — Stephen L. Sheldon

(57) ABSTRACT

An electronic connector comprises: an insulating body, a plurality of terminals contained in the insulating body, a metal shield housing the insulating body, and a light pipe covering the metal shield. The insulating body and the metal shield define a mating space having an inserting opening. The light pipe is made of transparent, compressible LSR and comprises a base body and a ring sealing gasket in front of the base body covering the periphery of the insertion opening. When the electronic connector is assembled in a panel, the sealing gasket is held between a hold of the panel and the metal shield to form a sealing structure, so that the electronic connector and assembly comprising the same are excellently waterproofed.

9 Claims, 8 Drawing Sheets

ELECTRONIC CONNECTOR AND ASSEMBLY COMPRISING THE SAME

RELATED APPLICATIONS

This application claims priority to Chinese Patent Application No. 201020268912.4, filed Jul. 22, 2010, which is incorporated herein by reference in its entirety.

FIELD OF THE INVENTION

The present invention relates to an electronic connector and assembly comprising the same, and more particularly, to an electronic connector including a light pipe and assembly comprising the same.

BACKGROUND ART

As electronic and information technology for decoration or indication etc. develops, electronic products adapt more and more light effects.

Chinese patent application No. 200810124035.0 discloses an electronic connector assembly 8 having a light emitting device for decorating the design by light effect. The electronic connector assembly 8 comprises an electronic connector 80, light emitting components 81 indicating the on-off status of the electronic connector 80 and decorating the electronic connector 80, and a transmission component 82 cooperating with the light emitting component 81. The electronic connector 80 comprises an insulating body 800, a plurality of terminals (not shown) positioned in the insulating body 800, and a metal shield 802 covering the insulating body 800. The light emitting components 81 are two opposite LEDs (light-emitting diodes) or EL (electroluminescence) slices. The transmission component 82 is made of a material with high transmission rate and comprises a transmission base 820 and two transmission side bodies 821 on two sides of the transmission base 820. The front end of the transmission base 820 is provided with a transmission ring 822. One side of the transmission body 821 is connected to the transmission base 820, and the other side thereof is adjacent to the light emitting component 81. The physical dimension of the transmission body 821 corresponds to the light emitting component 81. An exposed surface of the transmission ring 822 is coated with dispersion materials to achieve an effect of well-distributed illumination.

In assembly, the light emitting components 80 is fixed to cover the electronic connector 80, and the light emitting components 80 are distributed on the two sides symmetrical to the axis of center line of transmission ring 822 so that light from the light emitting component 81 transmits out through the transmission ring 822. Accordingly, the electronic connector assembly 8 can produce a ring source which can generate well-distributed light with materials coated on the exposed surface of the transmission ring 822, thereby curing the defect of poor light effect.

However, for electronic products working in poor or special conditions, waterproofing is important. Obviously, the above electronic connector assembly 8 cannot comply with such requirement because the shapes of the transmission ring 822 and the metal shield 802 do not correspond. They cannot be closely combined or achieve sealing with the panel. Therefore, further work is required to make the electronic connector and the assembly thereof complying with more and stricter requirements.

SUMMARY OF THE INVENTION

An embodiment of an electronic connector comprises an insulating body, a plurality of terminals contained in the insulating body, a metal shield housing the insulating body, and a light pipe covering the metal body. The insulating body and the metal shield define a mating space having an insertion opening in the front end thereof. The light pipe is transparent/translucent and compressible, and comprises a base body and a ring sealing gasket formed in the front of the base body covering a periphery of the insertion opening.

According to one embodiment, the electronic connector is a Micro-USB electronic connector which further comprises two holding holes formed through the top of the metal shield; corresponding to the two holding holes, the base body's top of the light pipe rises outward so that a receiving space is provided in the corresponding internal side; the light pipe is made of LSR (liquid silicon rubber); and the terminals are contained in the insulating body by insert molding.

In addition, one embodiment provides an electronic connector assembly which comprises: an electronic connector, at least one light source, at least circuit board, and a panel with a hole, wherein the electronic connector and the at least one light source are mounted on the at least one circuit board, and then assembled in the panel, and the sealing gasket covers a periphery of the insertion opening and is held between the hole of the panel and the metal shield.

BRIEF DESCRIPTION OF THE DRAWINGS

The invention will be described according to the appended drawings in which.

DETAILED DESCRIPTION OF THE INVENTION

The detailed description that follows describes exemplary embodiments and is not intended to be limited to the expressly disclosed combination(s). Therefore, unless otherwise noted, features disclosed herein may be combined together to form additional combinations that were not otherwise shown for purposes of brevity.

In an embodiment an electronic connector and assembly comprising the same can, besides transmitting light, provide a light pipe of the electronic connector that further has a sealing gasket. Thus, compared with prior art, the depicted disclosure not only achieves the desired light effects, but also has excellent waterproofing which allows it to work in poor conditions.

Figure 1:
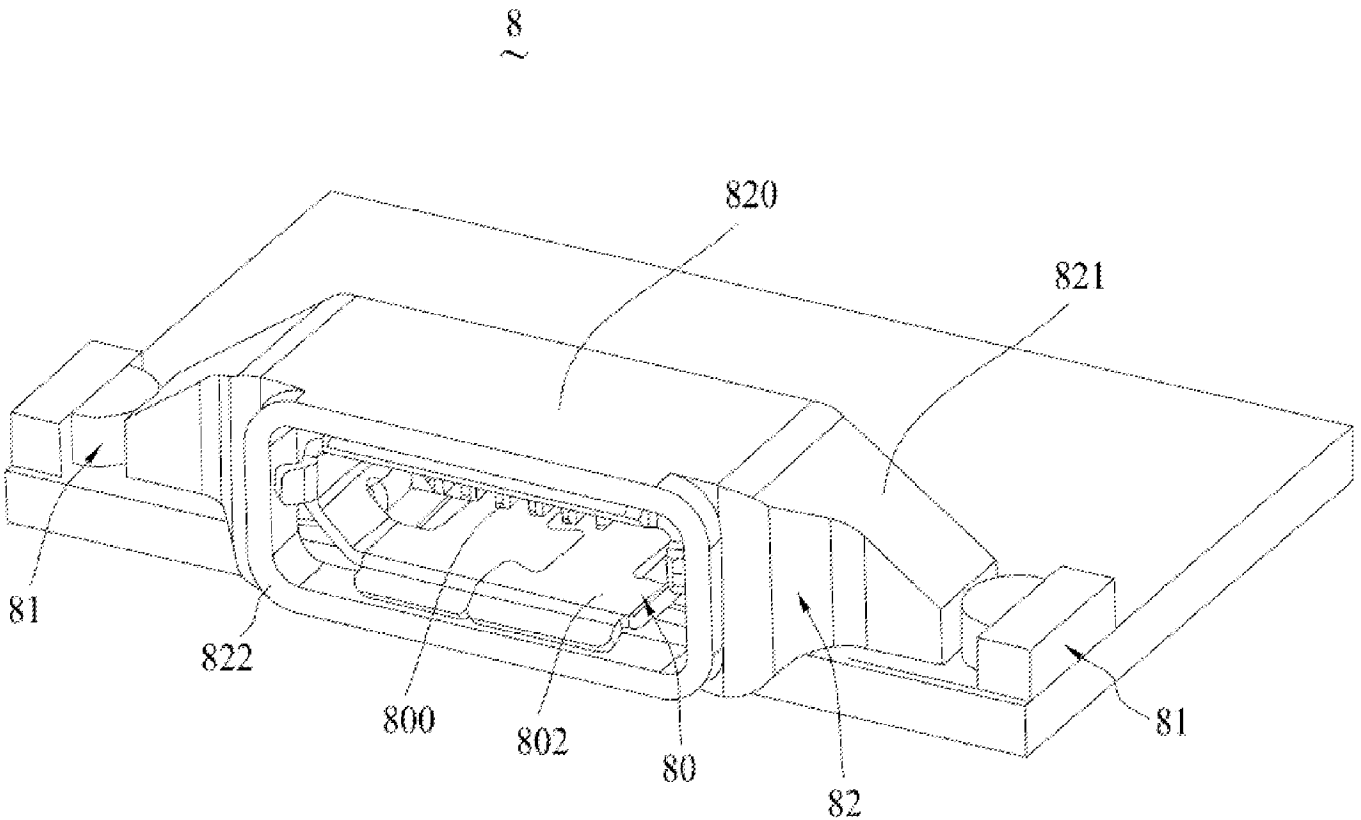
FIG. 1 (Prior Art)
FIG. 1 is a perspective view of a prior electronic connector assembly.
Figure 2:
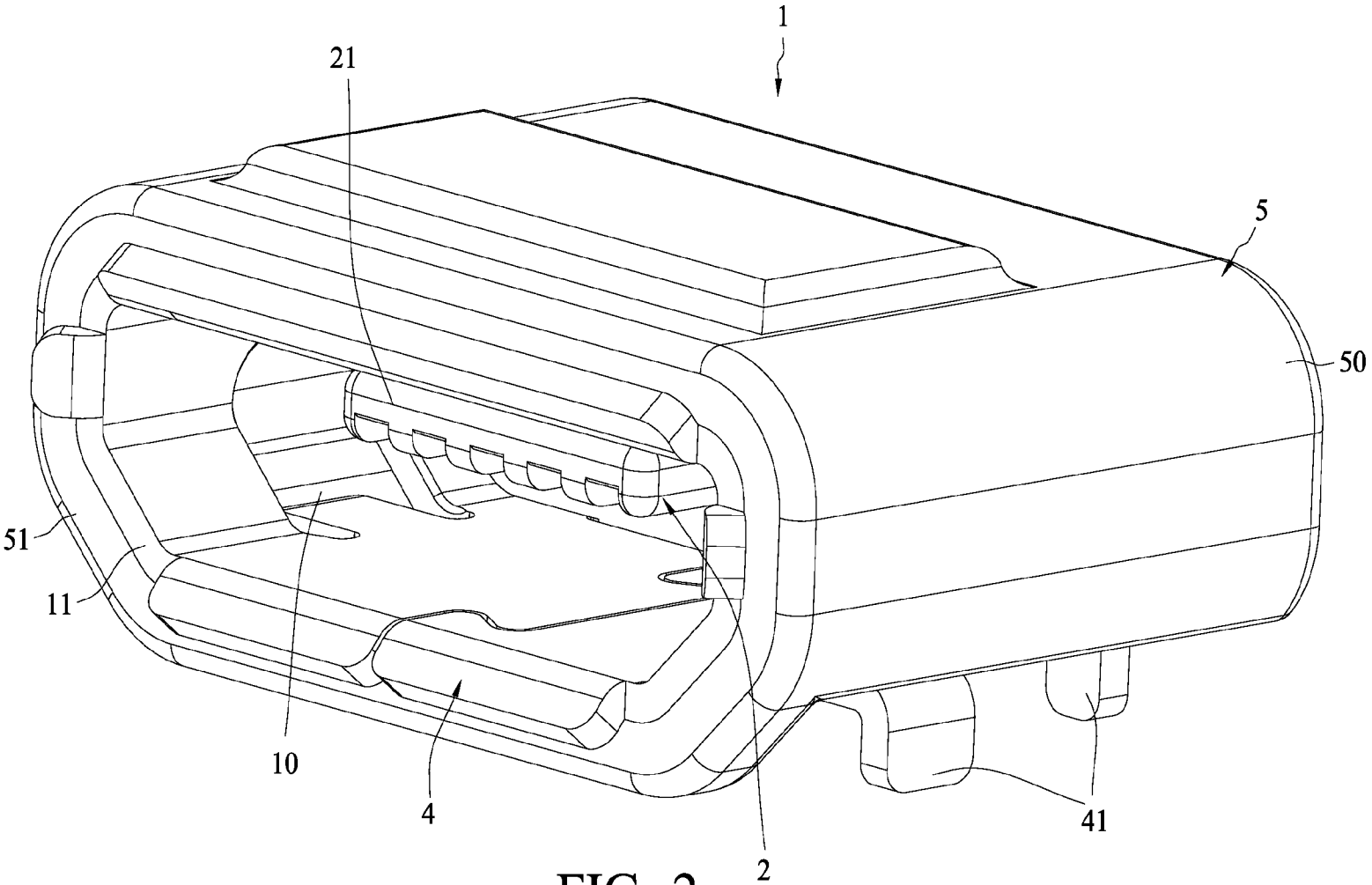
FIG. 2 is a perspective view of an embodiment of an electronic connector.
Figure 3:
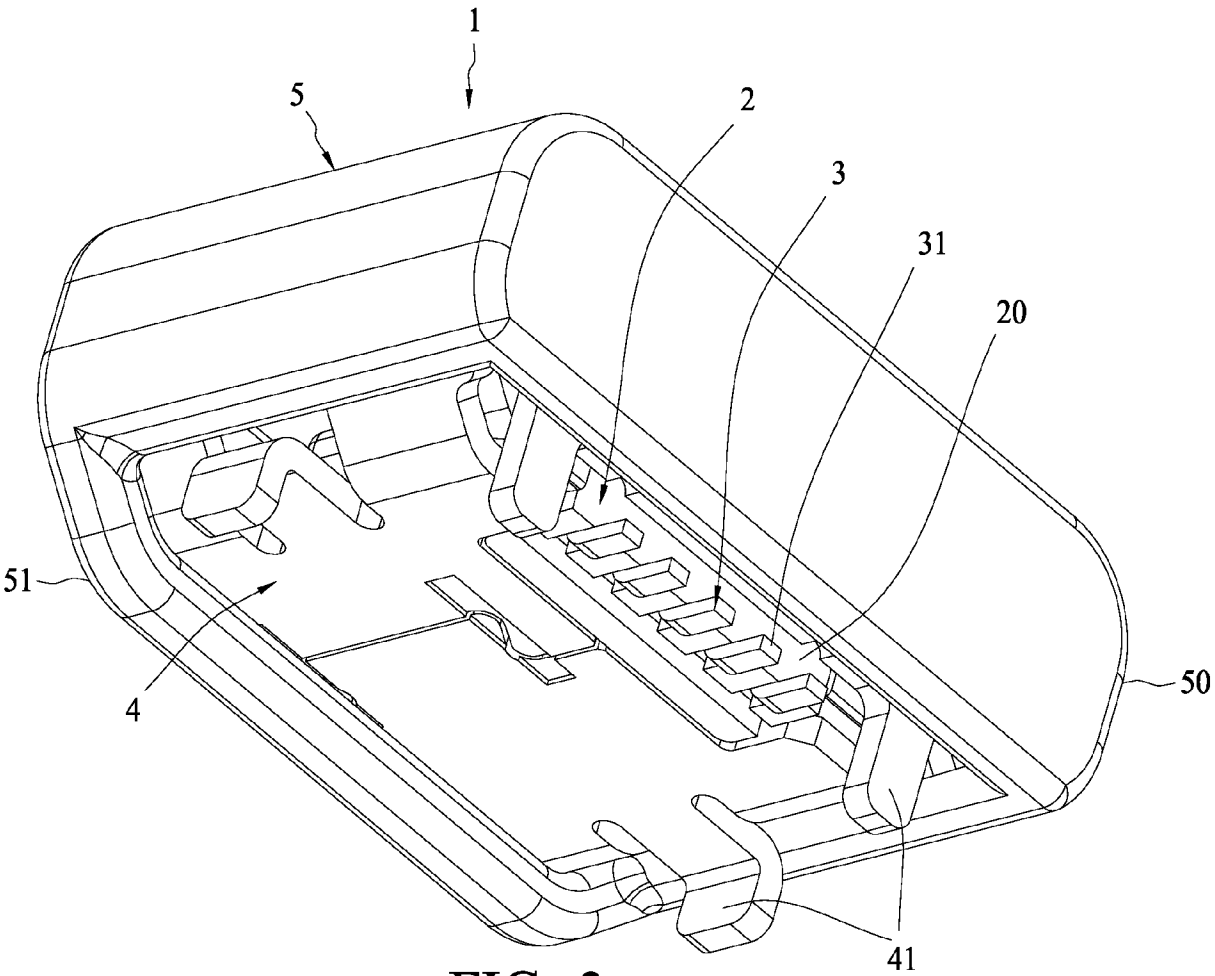
FIG. 3 is a perspective view of an embodiment of electronic connector.

FIGS. 2 and 3 demonstrate an electronic connector 1 according to one embodiment. As shown in FIGS. 2 and 3, the electronic connector 1 according to one embodiment is an Micro-USB (micro-universal serial bus) connector, comprising an insulating body 2, a plurality of terminals 3 placed in the insulating body 2 by insert molding, a metal shield 4 housing the insulating body 2, and a light pipe 5 covering the metal shield 4. The insulating body 2 and the metal shield 4 together define a mating space 10, so that a corresponding connector (not shown) can be inserted therein through an insertion opening 11 of the mating space 10 to mate with the terminals 3.

Figure 4:
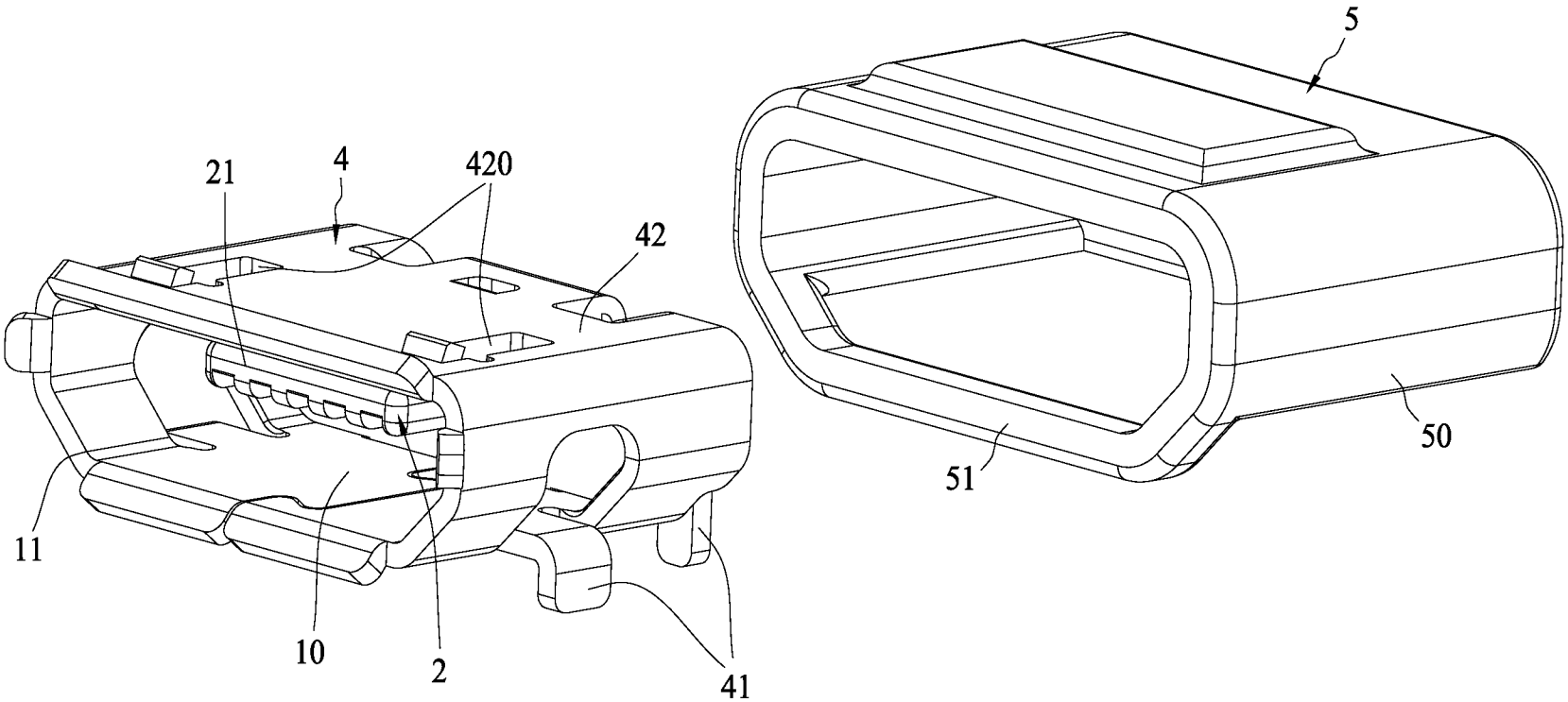
FIG. 4 is a perspective view of an embodiment of an electronic connector with a detached light pipe.
Figure 5:
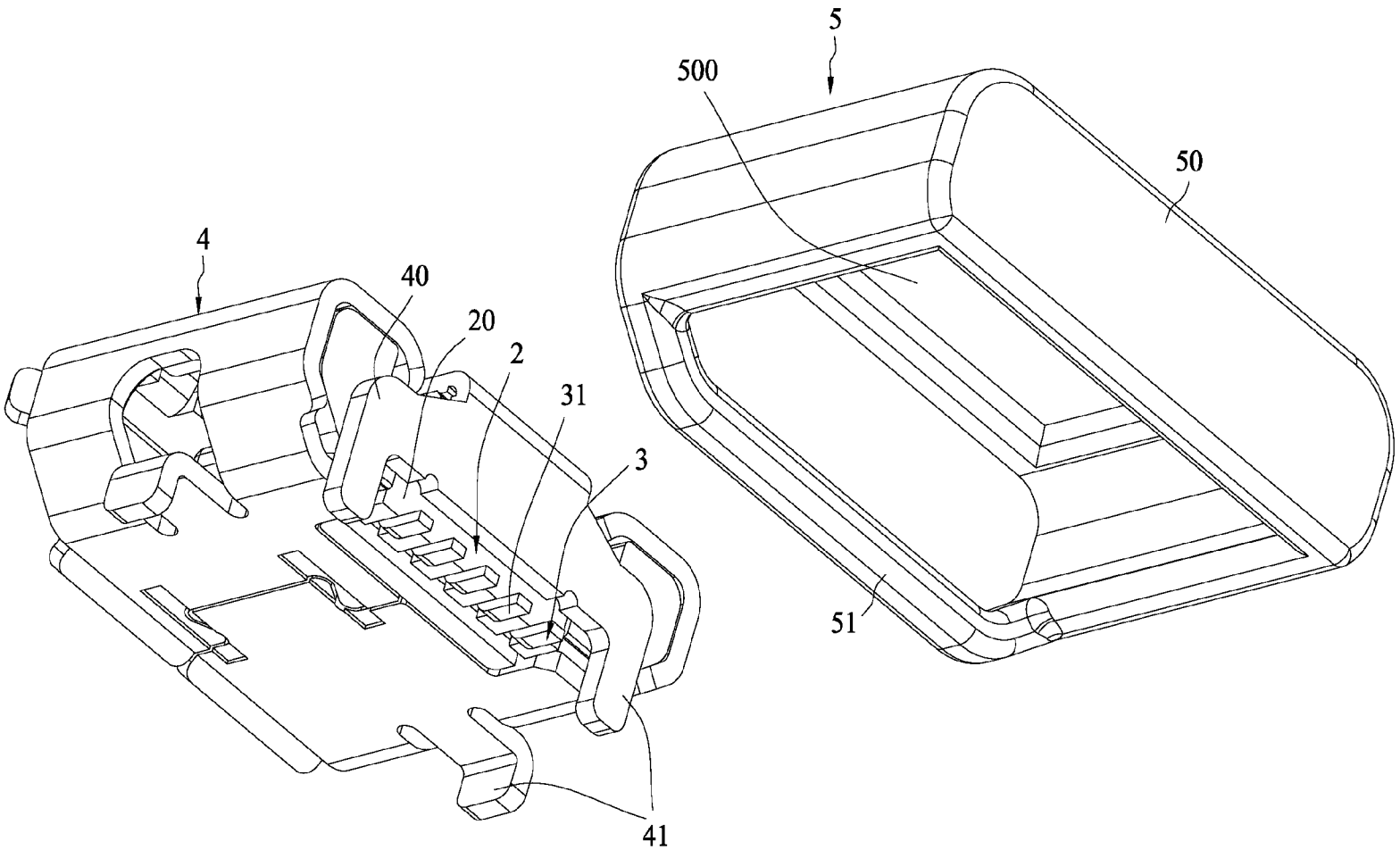
FIG. 5 is a perspective view of an embodiment of an electronic connector with a detached light pipe.
Figure 7:
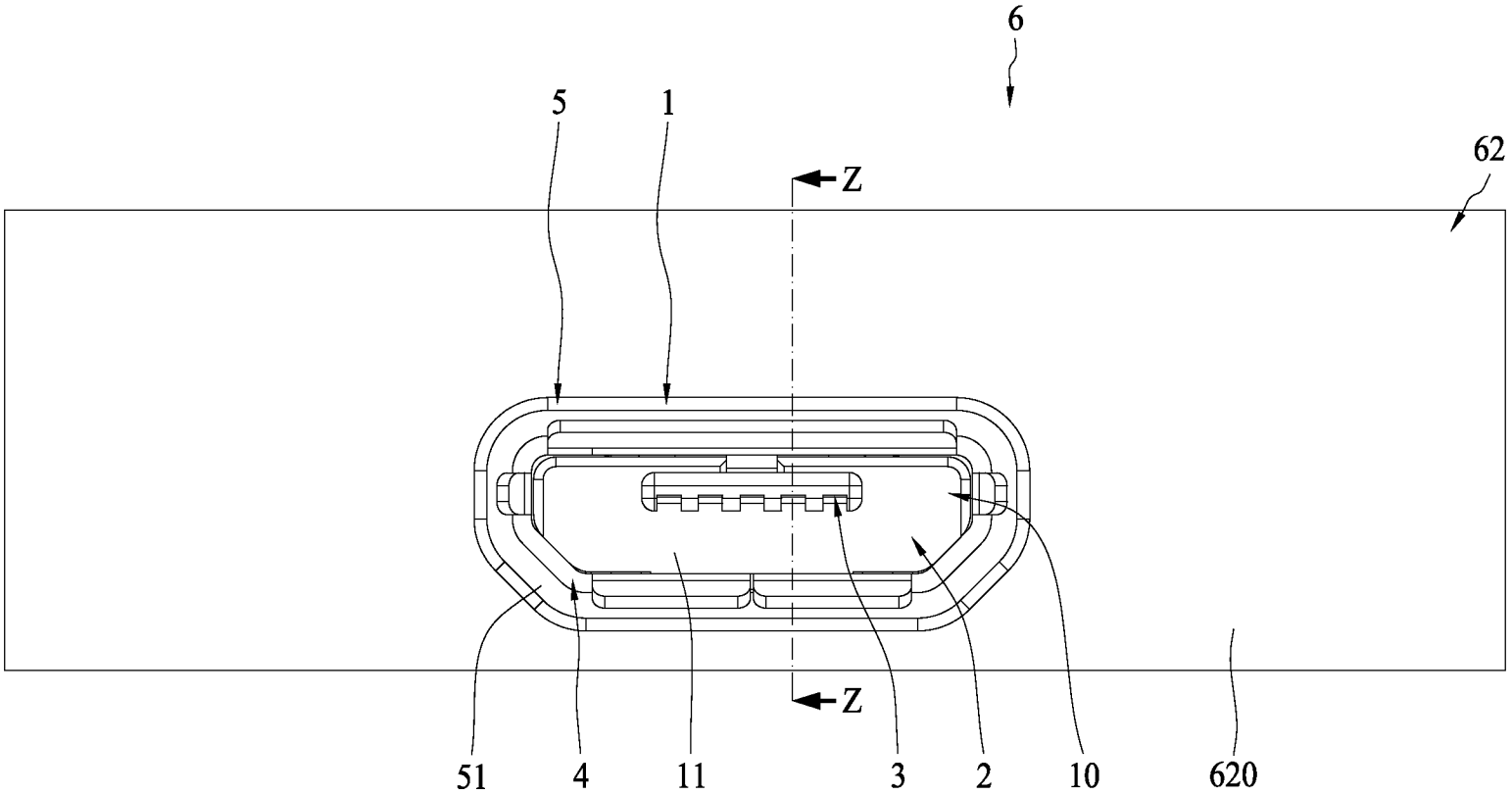
FIG. 7 shows a front view of an embodiment of an electronic connector assembly.
Figure 8:
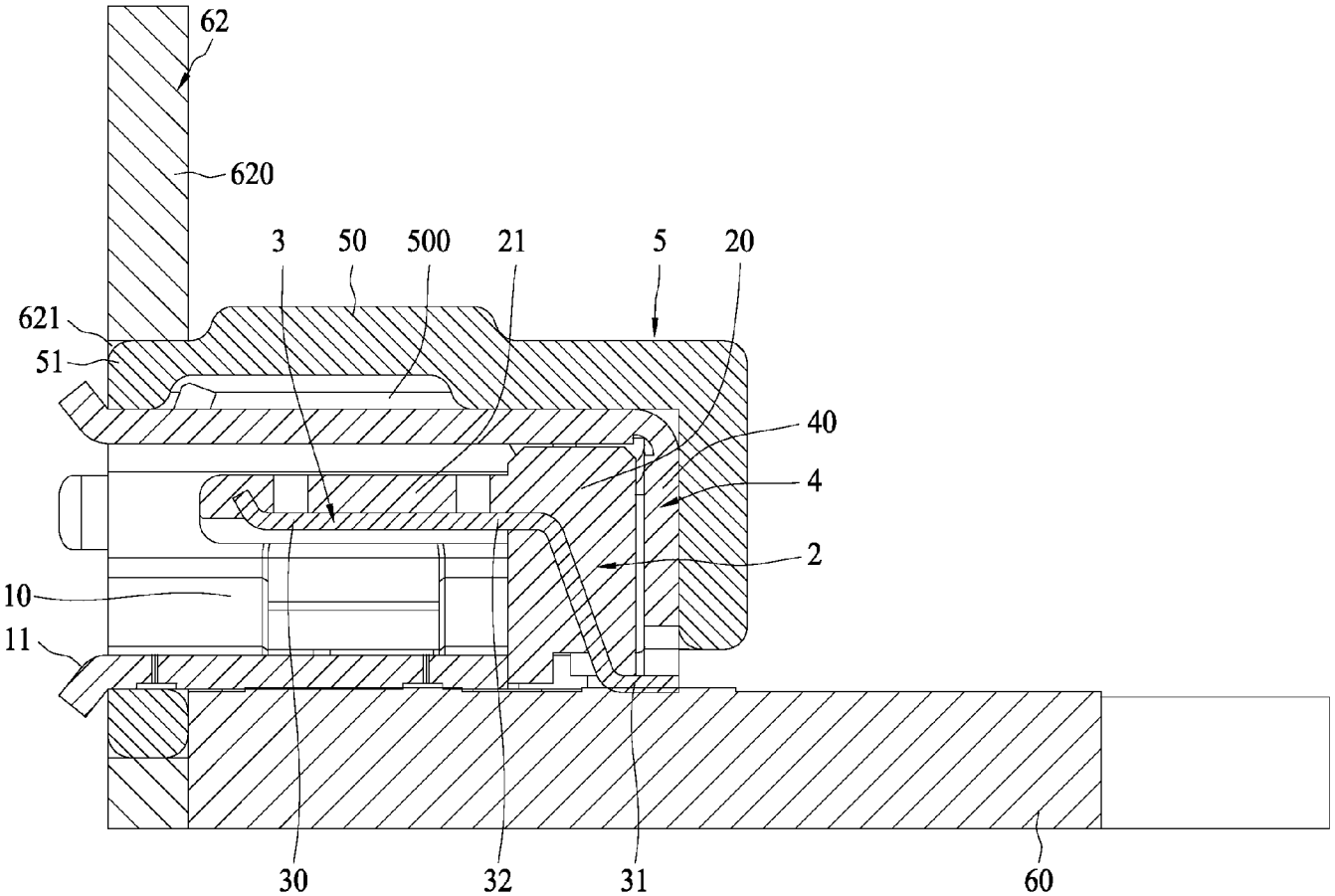
FIG. 8 shows the electronic connector assembly in FIG. 7 along a ZZ direction.

FIGS. 4 and 5 show an electronic connector with a detached light pipe according to one embodiment, and FIG. 8 shows the electronic connector assembly in FIG. 7 along a ZZ direction. The insulating body 2 has a base 20 substantially in the shape of a rectangle, and a mating portion 21 protruding from a front surface of the base 20. Each terminal 3 is bent from the mating portion 21, extends to the base 20, and comprises a contact portion 30, a soldering portion 31, and a connecting portion 32 connecting the contact portion 30 and the soldering portion 31 in sequence. The contact portion 30 mates with an inserted corresponding electronic connector, and the soldering portion 31 extends out of the insulating body 2.

The metal shield 4 is made of a metal board through a process of connecting following bending. A back portion 40 of the metal shield 4 is bent and then lies on the back end of the insulating body 2. At least one soldering foot 41 extends from the lower portion of the metal shield 4. In addition, two holding holes 420 are formed through a top portion 42 of the metal shield 4. When the electronic connector 1 mates with the inserted corresponding electronic connector, the two holding holes 420 will respectively hold locking components on the corresponding electronic connector.

The light pipes 5 is made of LSR (liquid silicon rubber), whose properties allow the light pipe 5 to be transparent/translucent so that light can pass, to be compressible for high elasticity, and to withstand high temperature under a reflow environment. The light pipe 5 and metal shield 4 have matching shapes so that the light pipe 5 closely covers the metal shield 4. In detail, the light pipe 5 has a base body 50 and a sealing gasket 51 in the shape of a ring formed in the front end of the base body 50. The bottom of the base body 50 is cutout in order to expose the bottom of the metal shield 4. The top of the base body 50 rises outward so that a receiving space 500 is provided in the corresponding internal side. If the corresponding electronic connector is inserted into the mating space 10, the locking component thereon will extend in the receiving space 500 after going through the holding holes 420 in the metal shield 4. Thus, the light pipe 5 will be protected from damage. The sealing gasket 51 covers the metal shield 4 corresponding to the periphery of the insertion opening 11.

For further application, the terminals' soldering portions 31 are soldered to a corresponding circuit board 60 by reflowing, and the metal shield 4 is also fixed to the circuit board 60 by the soldering feet 4.

Figure 6:
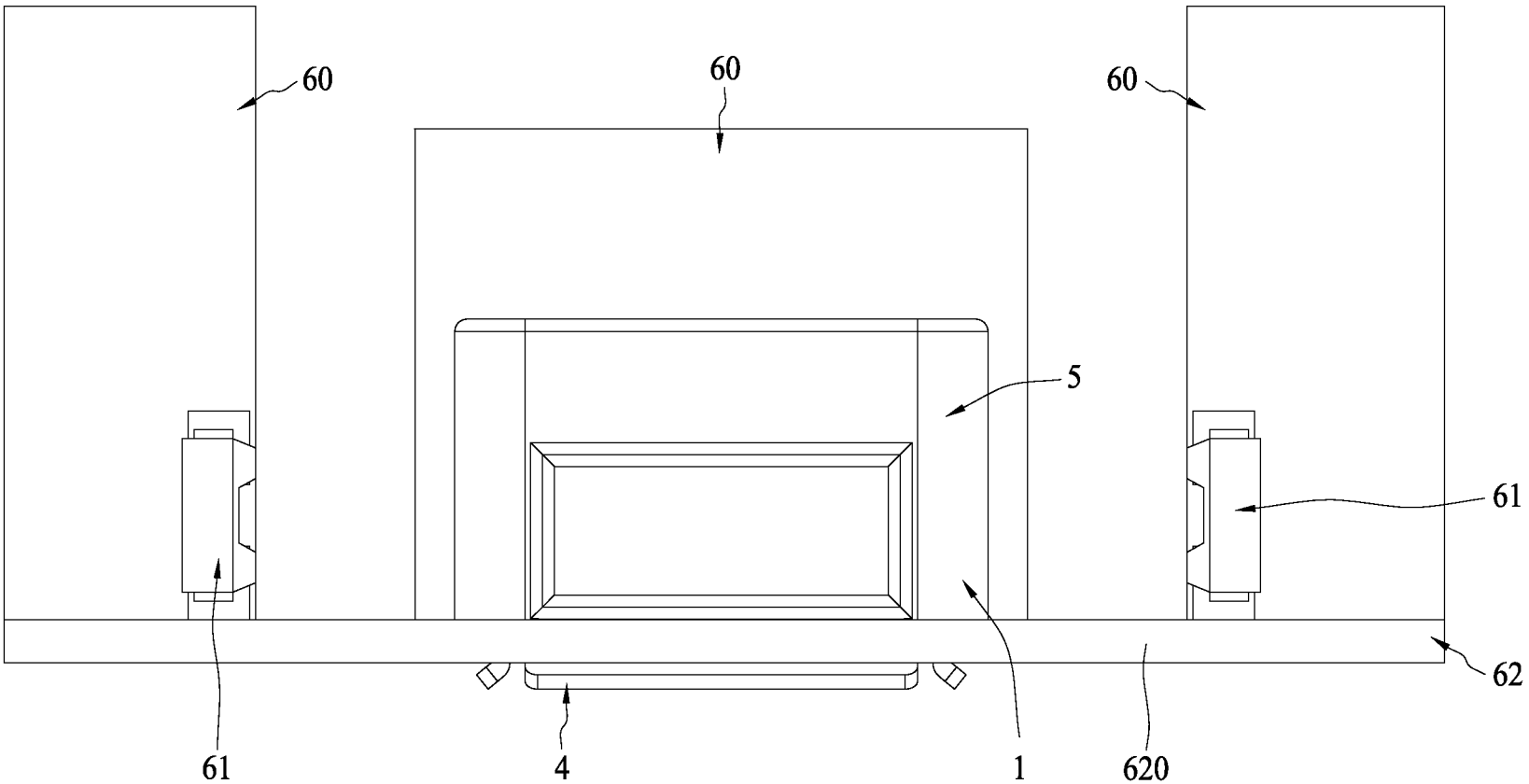
FIG. 6 shows a top view of an electronic connector assembly.

To produce various desired light effects, the electronic connector 1 need to cooperate with a light source etc., for example a LED. As shown in FIGS. 6, 7, and 8, in practice, an electronic connector assembly 6 according to one embodiment comprises an electronic connector 1, circuit boards 60, a pair of LEDs 61, and a panel 62. FIG. 6 shows an electronic connector assembly from the top according to one embodiment, and the top of the panel 62 is removed for convenient observation; and FIG. 7 shows an electronic connector assembly from the front according to one embodiment.

The LEDs 61 are fixed on the circuit boards 60 separately from the electronic connector 1 or together with the electronic connector 1; and they are respectively in the symmetrical sides of the electronic connector 1. Light from each LED 61 illuminates the corresponding side of the base body 50 of the light pipe 5 of the electronic connector 1, and then is transmitted by the light pipe 5 to the sealing gasket 51 in the front end of the light pipe 5 to generate a light ring. As a result, desired light effects are obtained.

Assemble the electronic connector 1 and LEDs 61 mounted on the circuit boards 60 in the panel 62. The front of the panel 62 is provided with a hole 621. The sealing gasket 51 of the light pipe 5 of the electronic connector 1 is stably held between the hole 621 and metal shield 4 for sealing, but the insertion opening 11 is exposed from the panel 62. When the electronic connector assembly 6 is applied in a poor environment or is splashed with water, the sealing structure of the light pipe 5 can prevent water seepage.

The above embodiments are illustrated to facilitate understanding of the provided disclosure, and should not be regarded as limitations to the present invention. For example, the electronic connector is not limited to Micro-USB; the terminals and insulating body can be assembled by insert connecting instead of insert molding; the structure of the terminals, the selection and arrangement of the source, etc. can vary; and even the light pipe's material is not limited to the above-mentioned LSR and can be any materials which is transparent/translucent, compressible, and withstanding high temperature. Compared with prior art, the depicted disclosure can advantageously act as a light pipe while also providing water resistance that it is suited for usage under different conditions.

The disclosure provided herein describes features in terms of preferred and exemplary embodiments thereof. Numerous other embodiments, modifications and variations within the scope and spirit of the appended claims will occur to persons of ordinary skill in the art from a review of this disclosure.

What is claimed is:

1. An electronic connector, comprising:

an insulating body;

a plurality of terminals contained in the insulating body;

a metal shield housing the insulating body, the insulating body and the metal shield defining a mating space having an insertion opening in a front end thereof; and a light pipe covering the metal shield, wherein the light pipe is transparent and/or translucent and compressible, and comprises a base body and a ring sealing gasket formed in the front of the base body, the ring sealing gasket covers a periphery of the insertion opening, wherein two holding holes are formed through a top portion of the metal shield, and corresponding to the two holding holes and a top of the base body of the light pipe rising outward so that a receiving space is provided in the corresponding internal side thereof.

2. An electronic connector of claim 1, wherein the light pipe is made of liquid silicon rubber (LSR).

3. An electronic connector of claim 1, wherein the terminals are placed in the insulating body by insert molding.

4. An electronic connector of claim 1, wherein the electronic connector is a Micro-USB electronic connector.

5. An electronic connector assembly, comprising:

an electronic connector, comprising:

an insulating body;

a plurality of terminals contained in the insulating body;

a metal shield housing the insulating body, the insulating body and the metal shield defining a mating space having an inserting opening in a front end thereof; and a light pipe covering the metal shield, wherein the light pipe is transparent/translucent and compressible and comprises a base body and a ring sealing gasket, wherein two holding holes are formed through a top portion of the metal shield, and corresponding to the two holding holes and a top of the base body of the light pipe rising outward so that a receiving space is provided in the corresponding internal side thereof;

at least one light source;

at least one circuit board; and a panel with a hole, wherein the electronic connector and the at least one light source are mounted on the at least one circuit board and then assembled in the panel, and the ring sealing gasket covers a periphery of the insertion opening and is held between the hole of the panel and the metal shield.

6. An electronic connector assembly of claim 5, wherein the light pipe is made of LSR.

7. An electronic connector assembly of claim 5, wherein the terminals are contained in the insulating body by insert molding.

8. An electronic connector assembly of claim 5, wherein the electronic connector is a Micro-USB electronic connector.

9. An electronic connector assembly of claim 5, wherein the at least one light source is two light-emitting diodes (LEDs), and the two LEDs are respectively in two symmetrical sides of the electronic connector.

* * * * *